US006074307A

United States Patent [19]

Hettema et al.

[11] Patent Number: 6,074,307

[45] Date of Patent: Jun. 13, 2000

[54] SET TRANSFORMATION EFFECT

[75] Inventors: Philip D. Hettema, Los Angeles, Calif.; William D. Mason, Orlando, Fla.

[73] Assignee: Universal City Studios, Inc., Universal CIty, Calif.

[21] Appl. No.: 09/229,528

[22] Filed: Jan. 12, 1999

[51] Int. Cl.[7] ..... A63J 1/02

[52] U.S. Cl. ..... 472/77; 472/74

[58] Field of Search ..... 472/77, 78, 80, 472/65, 136, 59, 74; 52/6, 7, 8, 9

[56] References Cited

U.S. PATENT DOCUMENTS

| | | | |
|---|---|---|---|
| 482,736 | 9/1892 | Hardy . | |
| 546,927 | 9/1895 | Lake . | |
| 797,372 | 8/1905 | Rice . | |
| 817,577 | 4/1906 | Miller . | |
| 1,112,307 | 9/1914 | Manterola . | |
| 2,935,316 | 5/1960 | Bradstreet . | |
| 3,345,066 | 10/1967 | Izenour | 472/78 |
| 3,487,595 | 1/1970 | Schumann | 52/6 |
| 3,690,617 | 9/1972 | Butler . | |
| 4,888,892 | 12/1989 | Ortega . | |
| 5,156,333 | 10/1992 | Worsfold | 472/65 X |
| 5,711,713 | 1/1998 | Krueger | 472/77 |
| 5,868,628 | 2/1999 | Drobnis et al. | 472/81 |

*Primary Examiner*—Kien T. Nguyen
*Attorney, Agent, or Firm*—Lyon & Lyon LLP

[57] ABSTRACT

An amusement attraction provides a set transformation effect. The audience watches a presentation in a viewing area. A moveable, open-bottomed flying set piece is located at a raised position above the viewing area. The flying set piece is hidden from the audience when the audience enters the viewing area. The flying set piece is attached to an overhead rigging system. A drive system lowers the flying set piece from the raised position above the viewing area to a lowered position such that the flying set piece surrounds the audience in the viewing area. The audience perceives that they have been transported back to different location within the attraction.

17 Claims, 9 Drawing Sheets

SET TRANSFORMATION EFFECT

BACKGROUND OF THE INVENTION

The field of the invention relates to amusement rides, shows or attractions.

Amusement or theatrical attractions have long been employed to give guests the impression of movement in various fantasy worlds. For example, almost 100 years ago, a theatrical scenic apparatus was described (in U.S. Pat. No. 817,577) in which patrons can view scenic effects as they travel up and down in elevators suspended from pulleys. Similarly, a Subterranean Exhibition Apparatus (as described in U.S. Pat. No. 482,736) was intended to give patrons the effect of traveling down into a subterranean world which the patrons can explore.

In another technique using elevators, (as shown in U.S. Pat. No. 797,372) an amusement ride simulates an elevator car that travels to a subterranean location. The elevator car simulates upward and downward movement of the patrons. Adjacent to the elevator are two compartments suspended over a well by a cable and pulley system attached to a counterbalancing weight to permit the compartments to move up and down. When the guests are located in the elevator car, the adjacent compartments are raised or lowered into position adjacent the elevator car. The attraction creates the impression on the passengers of traveling from the surface of the earth to a subterranean location, then returning to the surface.

While these and other designs may have been successful in their era, none of them were able to create the illusion of being magically transported to another location nearly instantaneously, and without actually physically moving the guests or audience.

Unlike these known attractions, an attraction having a feature that imparts on the guests the feeling of being nearly instantly transported to another location is desirable. In such attraction or show, the guests would be baffled and astonished as to how they were magically transported to another location without experiencing any movement.

Consequently, there remains a need for an amusement attraction or show that gives the guests the feeling of being transported to another location without the guests experiencing any feeling of physical movement. The guests would thus feel as if they had been nearly instantaneously transported, in an unperceived way, to a different location within the amusement ride.

SUMMARY OF THE INVENTION

In a first aspect of the present invention, an amusement attraction for simulating a set transformation effect for guests is described. The amusement attraction preferably includes a viewing area in which the guests view a theatrical performance or attraction. A moveable set piece is advantageously located above the viewing area in a raised position, hidden from the guests when they enter the viewing area. The amusement attraction also includes a system for lowering the set piece from the raised position above the viewing area to a lowered position such that it advantageously surrounds the guests in the viewing area.

In second and separate aspect of the present invention, an amusement attraction includes first and second viewing areas. The guests preferably pass through the first viewing area before entering the second viewing area. Upon entering the second viewing area, guests may view a theatrical performance or attraction. A moveable, open-bottomed set piece is located at a raised position above the second viewing area, hidden from the guests as they enter the second viewing area. At an appropriate time, after the guests are in the second viewing area, the set piece is quickly lowered around the guests. As the inside surfaces of the set piece which are facing the guests have two or three dimensional images or scenery, different from those in the second viewing area, the guest perceive that they have moved to a different location.

Accordingly, it is an object of the present invention to provide an improved amusement attraction. Other and further objects and advantages will appear hereafter.

BRIEF DESCRIPTION OF THE DRAWINGS

In the drawings, wherein the same reference number designates the element, in all of the views:

FIG. 6(*b*) is a top view thereof.

DETAILED DESCRIPTION OF THE PREFERRED EMBODIMENT.

Figure 1:
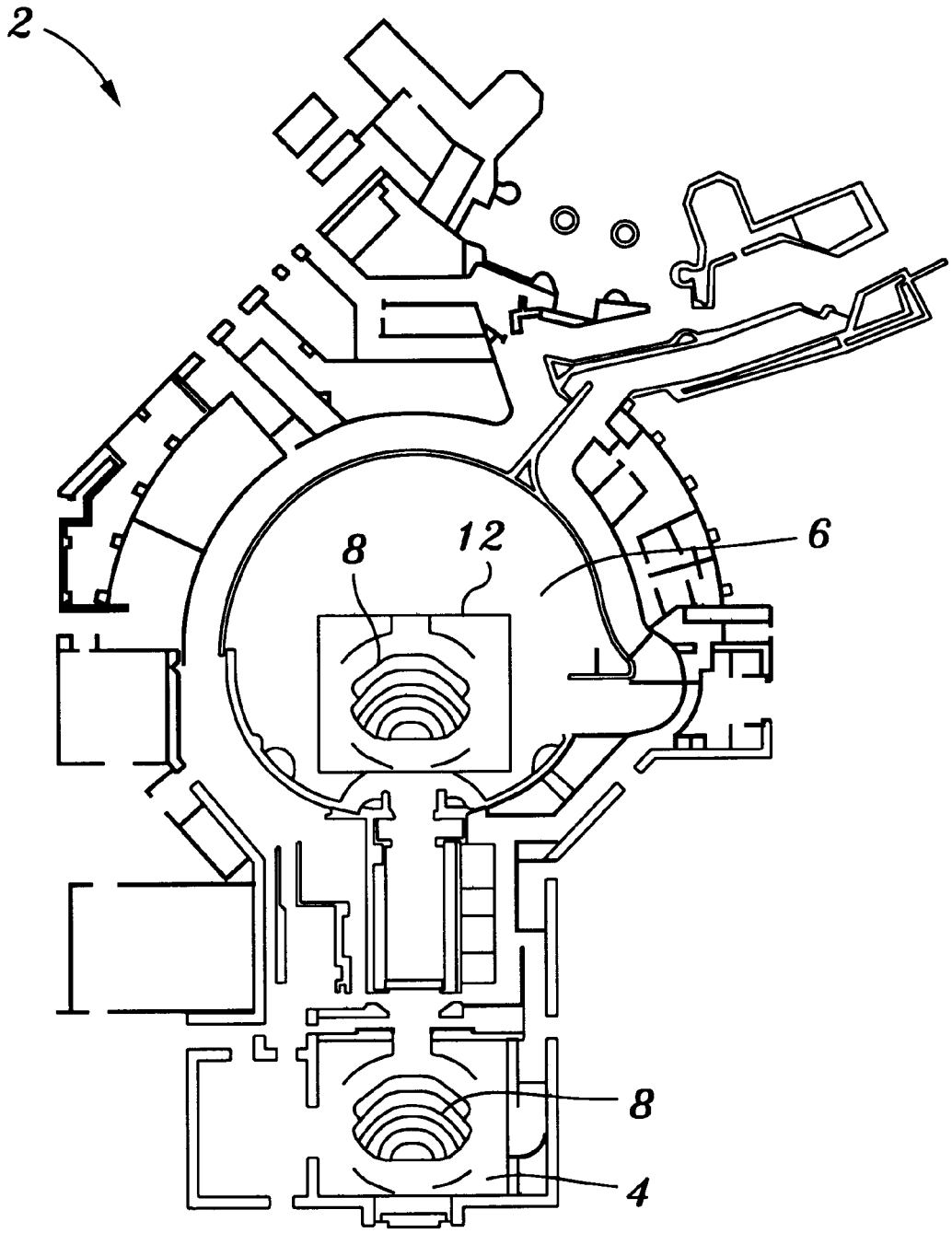
FIG. 1 is a plan view of an amusement attraction according to the invention.

FIG. 1 illustrates the layout of an attraction 2 having a set transformation effect. The amusement attraction 2 preferably includes a main show area 6, and a pre-show area 4. The term "pre-show area" 4 means a show area that the guests pass through, before entering the main show area 6.

Inside both the pre-show and main show areas 4, 6 are viewing areas 8, where guests stand or sit to view a theatrical presentation or attraction. The theatrical presentation or attraction can include, for example, live actors, special effects, show action equipment, static sets or props, and film or video presentations, etc.

In the preferred embodiment, guests enter the attraction 2 and continue (walking or riding on or in a vehicle) into one or more pre-show areas 4. In the pre-show area(s) 4, guests view a theatrical presentation or attraction that preferably "sets-up" the main attraction that is shown in the main show area 6. After the performance in the last pre-show area 2 has concluded, the guests enter into a main show area 6. Once inside the main show area 6, guests are directed to the viewing area 8. Inside the viewing area 8, the guests view the main theatrical presentation or attraction. At or near the finale of the main theatrical presentation, the set transformation effect is performed to make the guests magically feel as if they have been transported to another area of the attraction 2. For example, in one preferred embodiment of the invention, the guests feel as if they have been virtually instantly transported back to a previously visited pre-show area 4.

With reference to FIGS. 1 through 7, a description of how the set transformation effect is accomplished will now be described. The set transformation effect is made up of several components including a flying set piece 12, an overhead rigging system 20, a counterweighted sled assembly 30, a counterweight tower assembly 40, a drive train 48, and a controls/power system 70.

Figure 2:
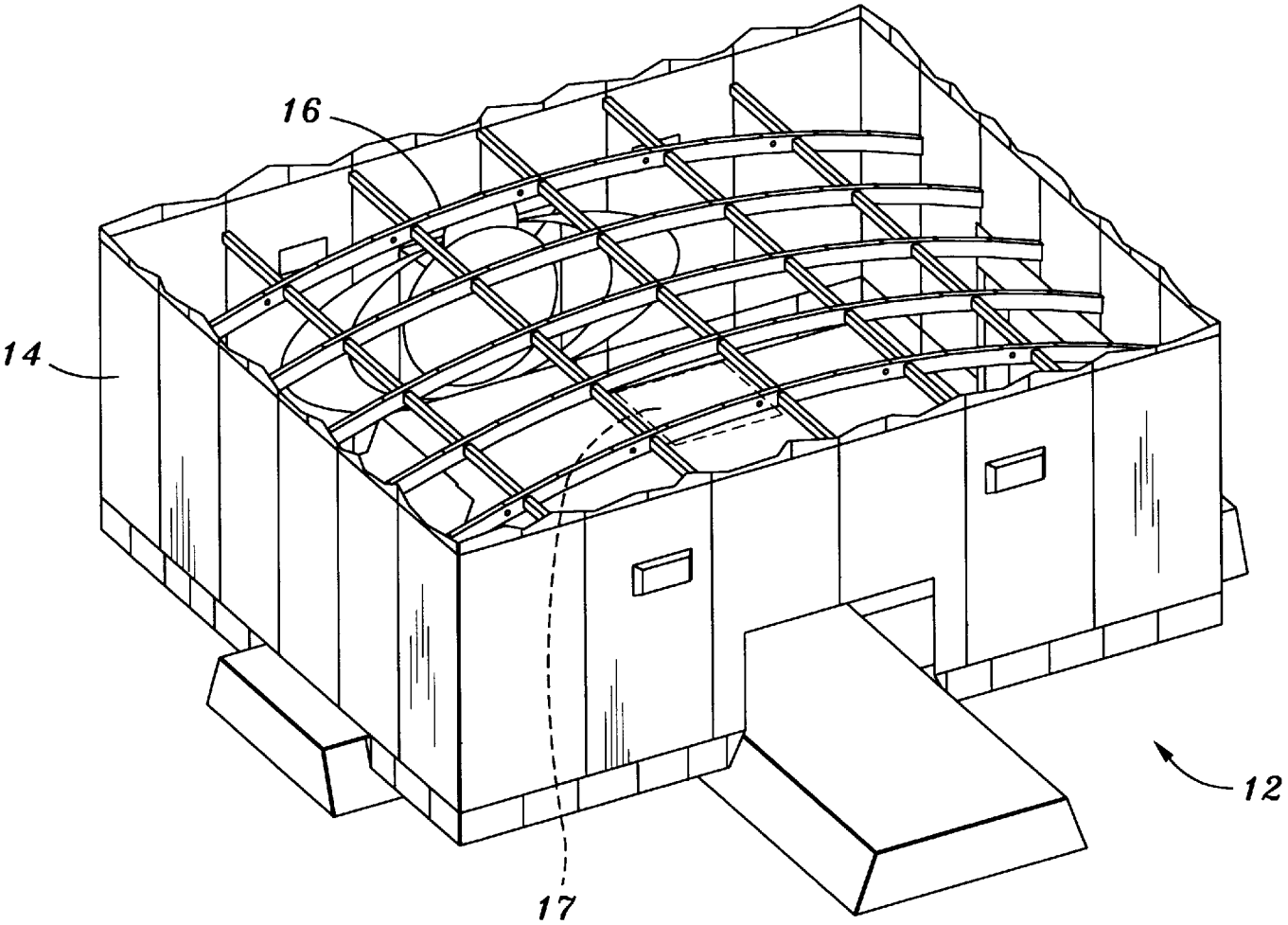
FIG. 2 is a perspective view of the flying set piece shown in FIG. 1, in the lowered position.
Figure 3:
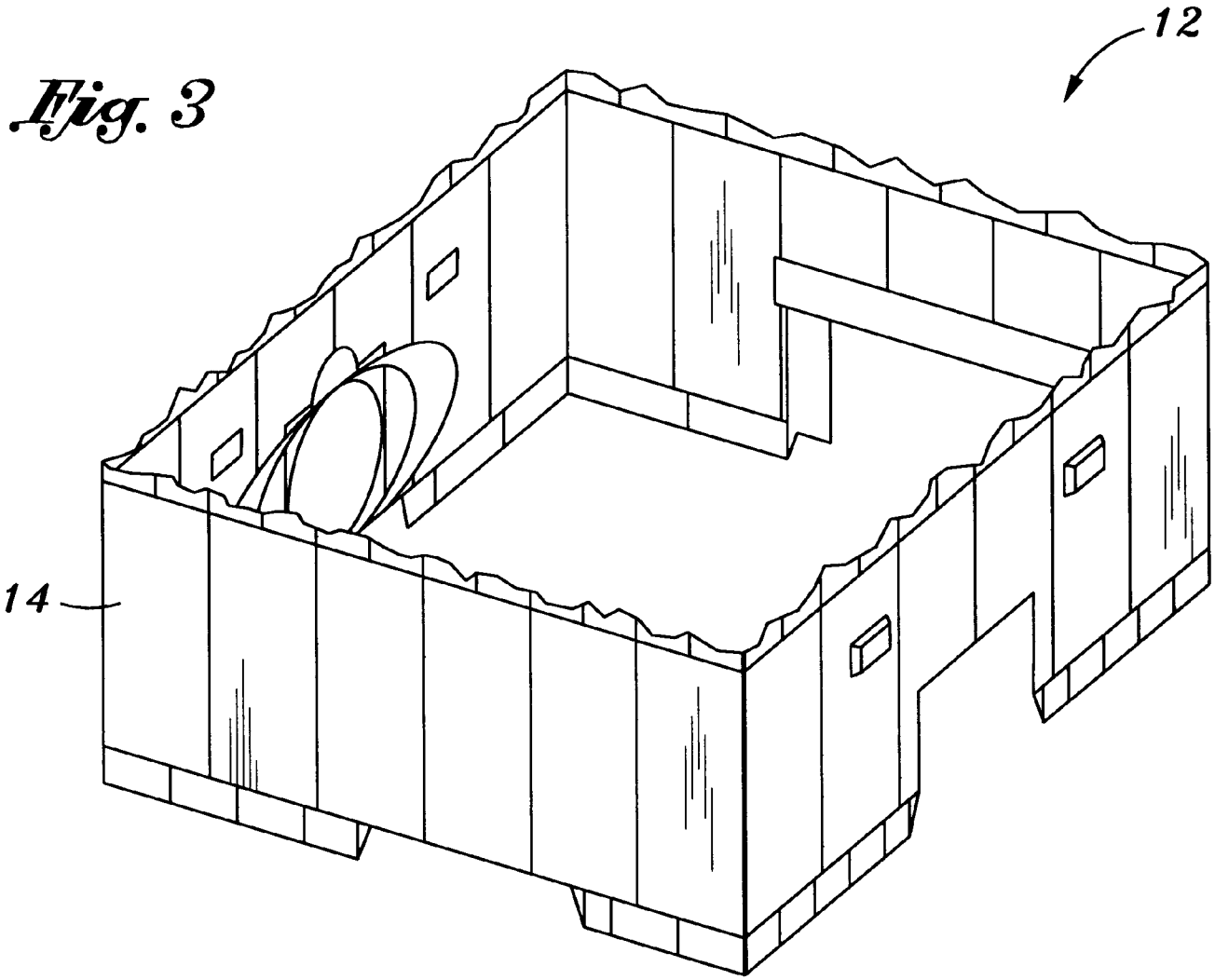
FIG. 3 is another perspective view of the flying set piece with the truss structure shown in FIG. 2 removed.

As shown in FIGS. 2 and 3, the flying set piece 12 is an open-bottomed structure having one or more walls 14. The walls 14 are preferably made of aluminum-skinned composite panels or the like. The use of a lightweight metal such as aluminum reduces the total weight of the flying set piece 12. While a flying set piece 12 having four walls 14 is preferred, any number of walls 12 can be used. The interior of the walls 14 are preferably painted or otherwise adorned with suitable materials, optionally including three dimensional props or sculpture, to resemble a desired scene. In one preferred embodiment, the interior walls 14 are painted to resemble the imagery seen by the guests in a previously visited prior show area 4, such as, for example, an ocean scene. The walls 14 may be flat or curved.

The walls 14 of the flying set piece 12 are structurally secured to an overhead lattice 16. The lattice 16 provides structural integrity to the entire flying set piece 12. As shown in FIG. 2, the lattice 16 is made of interlocking, continuous-length beams 18. The underside of the beams 18 are scenically prepared to create the desired appearance. For example, molded fiberglass covers 17 may be attached to the underside of the beams 18 of the lattice 16. In this way, the lattice 16 and the flying set piece 12 simulate the look and feel of a location in the attraction 2, i.e., a pre-show area 4, including the ceiling portion, when the flying set piece 12 is lowered around the guests.

Figure 4:
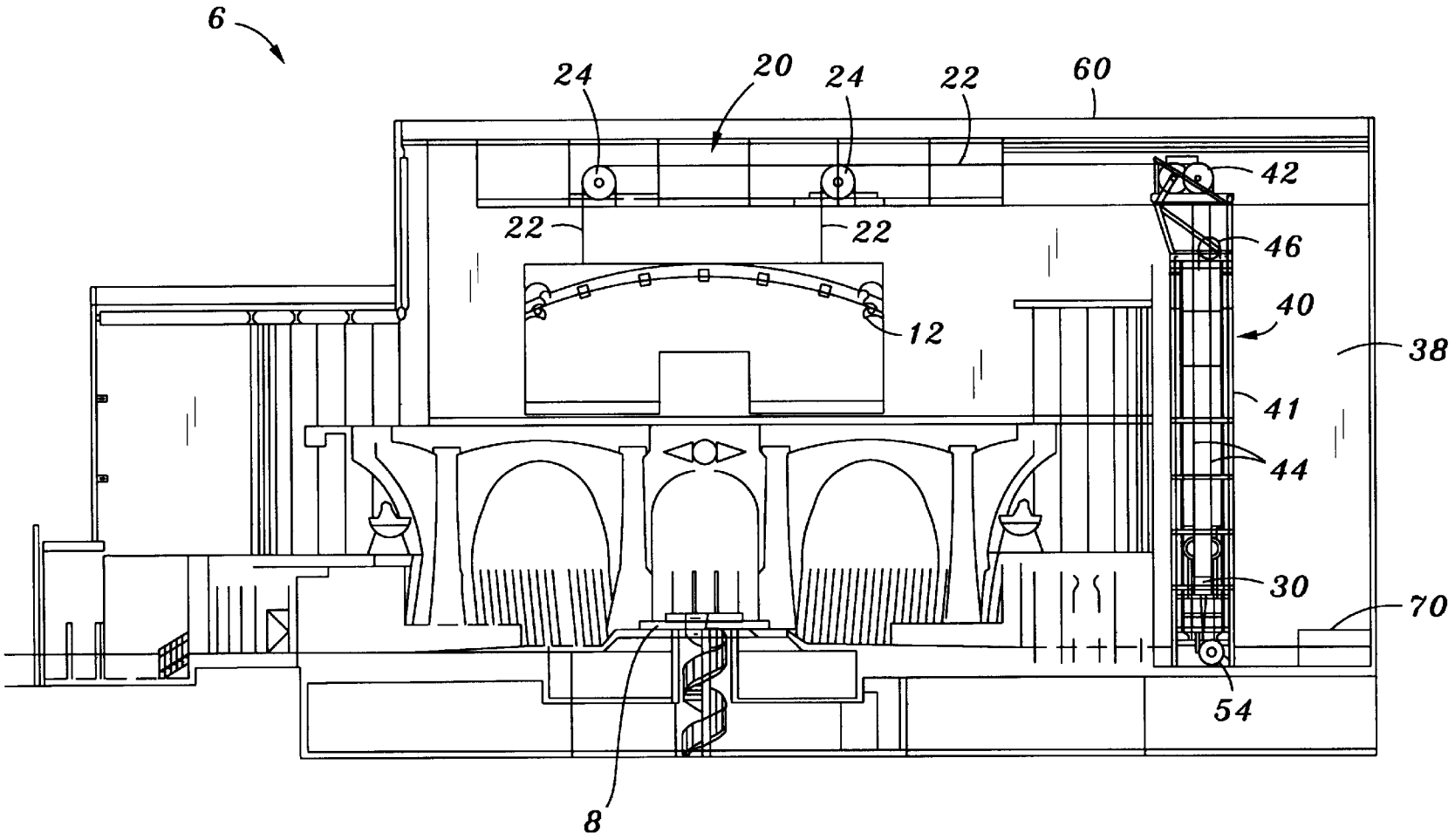
FIG. 4 is a front view of the attraction of FIG. 1, showing the flying set piece in the raised position above the main show area.
Figure 5:
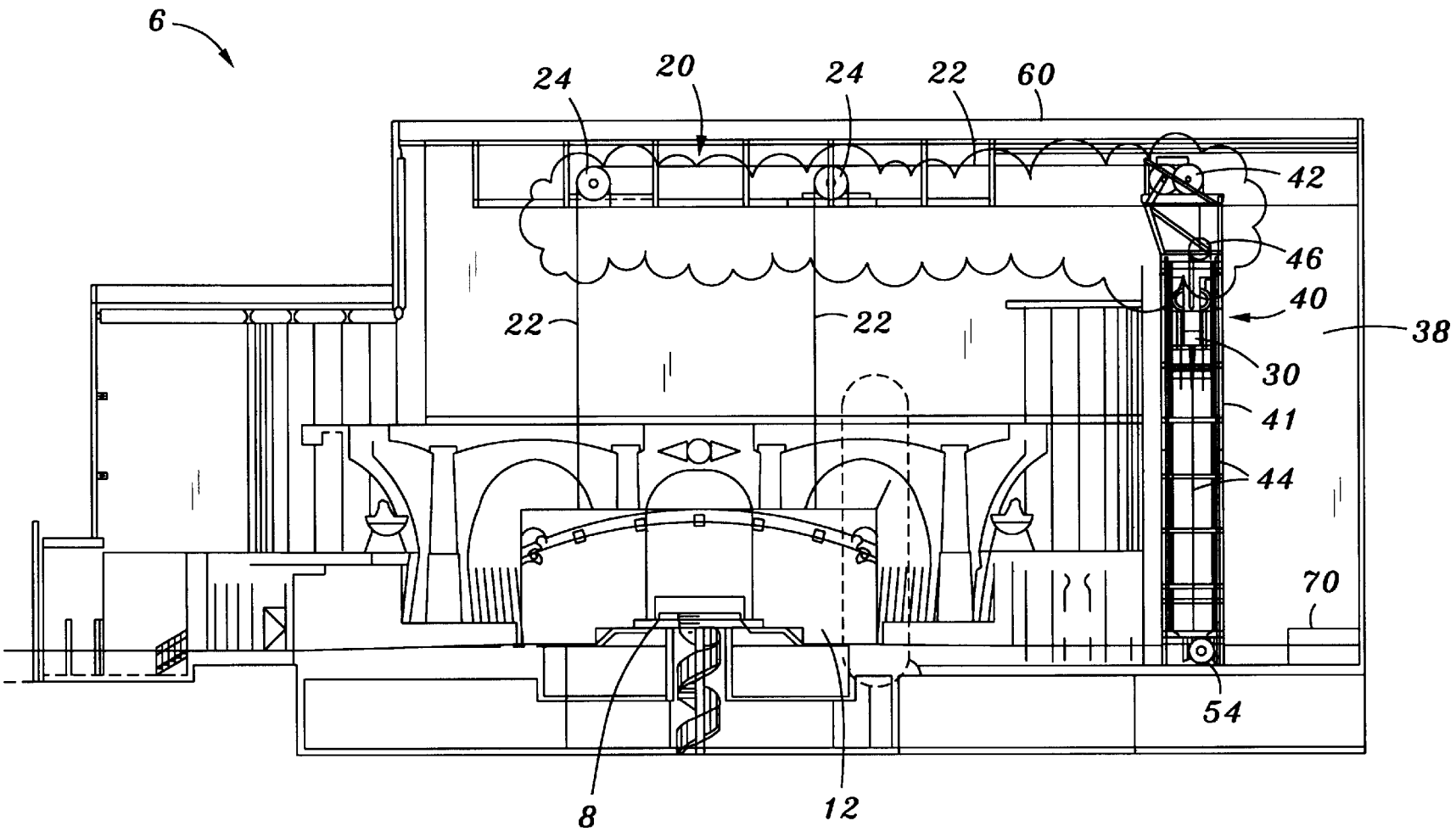
FIG. 5 is a front view thereof, showing the flying set piece in the lowered position in the main show area.

Referring now to FIG. 4, the flying set piece 12 is shown in the raised or up position above the main show area 6 and the viewing area 8 in which the guests are located. As shown in FIGS. 4 and 5, the entire flying set piece 12 is raised and lowered by an overhead rigging system 20 and a counterweight sled assembly 30. The counterweight sled assembly 30 is located within the counterweight tower assembly 40.

The overhead rigging system 20 includes a plurality of wire load ropes 22 that connect the flying set piece 12 to the counterweight sled assembly 30 located in the counterweight tower assembly 40. Preferably four wire load ropes 22 are used in the overhead rigging system 20 each preferably made of steel. The wire load ropes 22 are advantageously supported by four room load sheaves 24 and four tower load sheaves 42. The four room load sheaves 24 are preferably located directly above the flying set piece 12 and are attached (e.g., bolted and/or welded) to the topside of the lower cord of the facility ceiling trusses 60). The wire load ropes 22 preferably run from the four corners of the flying set piece 12 and pass over the four room load sheaves 24 and run horizontally to the four tower load sheaves 42 and travel down to and attach to the counterweight sled assembly 30.

The tower load sheaves 42 are located at the upper portion of the counterweight tower assembly 40. The tower load sheaves 42 are attached to the counterweight tower assembly 40.

Figure 6A:
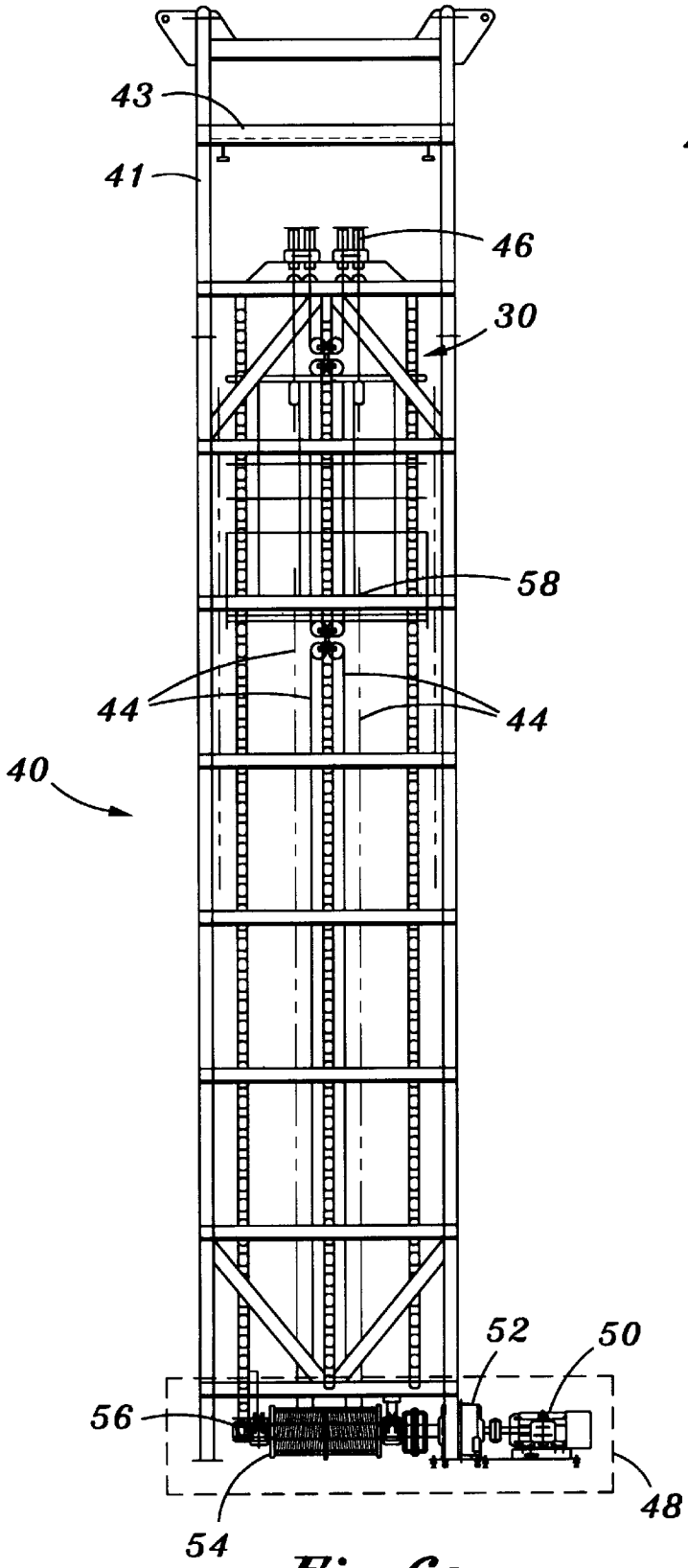
FIG. 6(*a*) is a front view of the counterweight tower assembly shown in FIG. 4.
Figure 6B:
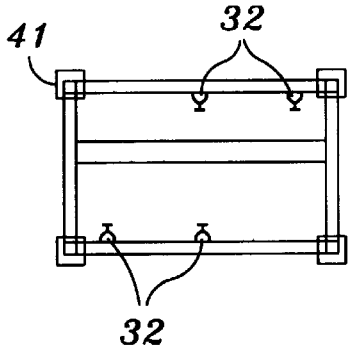

Referring now to FIGS. 6(*a*), 6(*b*), 7, and 8, the counterweight tower assembly 40 includes a frame 41, the moveable counterweight sled assembly 30, a plurality of haul ropes 44, a plurality of haul rope sheaves 46, and a drive train 48 that provides the motive force to move the counterweight sled assembly 30 and the flying set piece 12 up and down. Preferably, the entire counterweight tower assembly 40 is located in a mechanical room 38 that is separate and apart from the show areas 4, 6, and the viewing areas 8. In this way, the guests cannot see the counterweight tower assembly 40.

Figure 7:
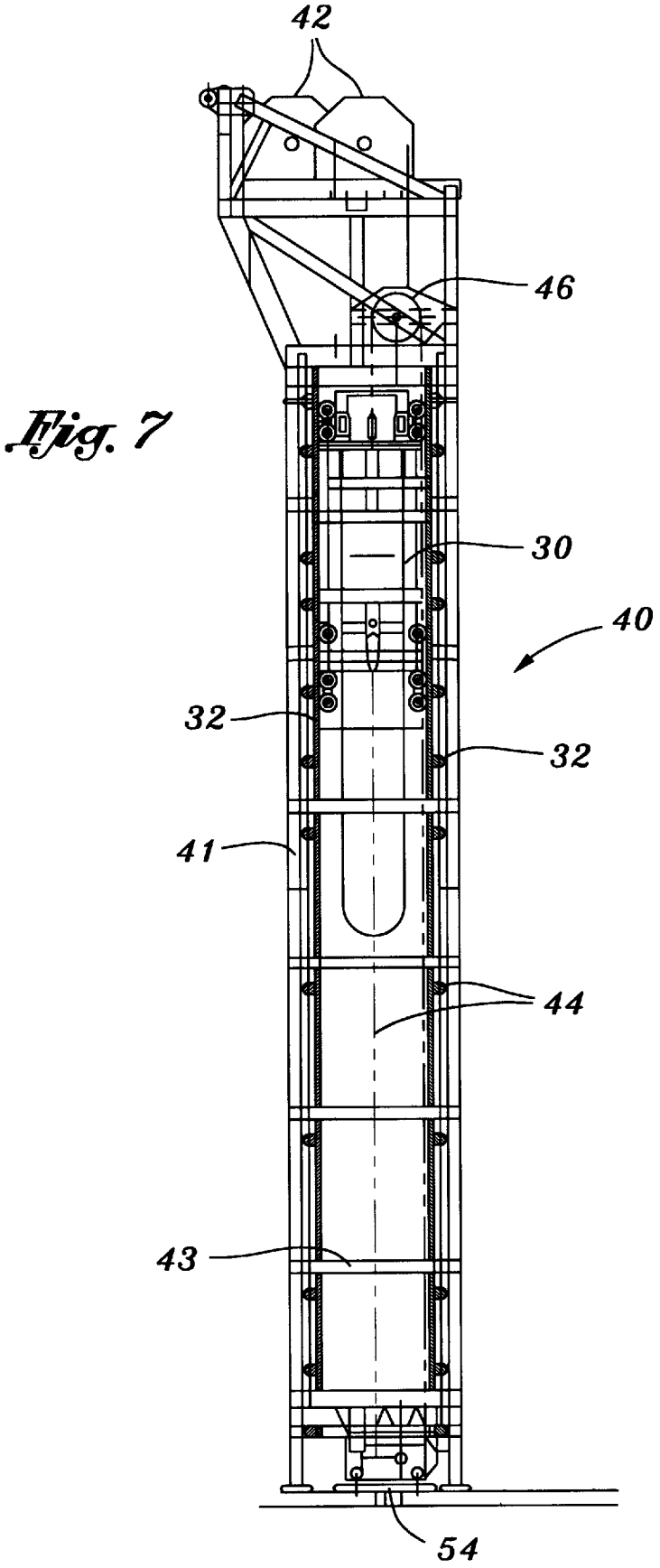
FIG. 7 is a side view thereof.
Figure 8:
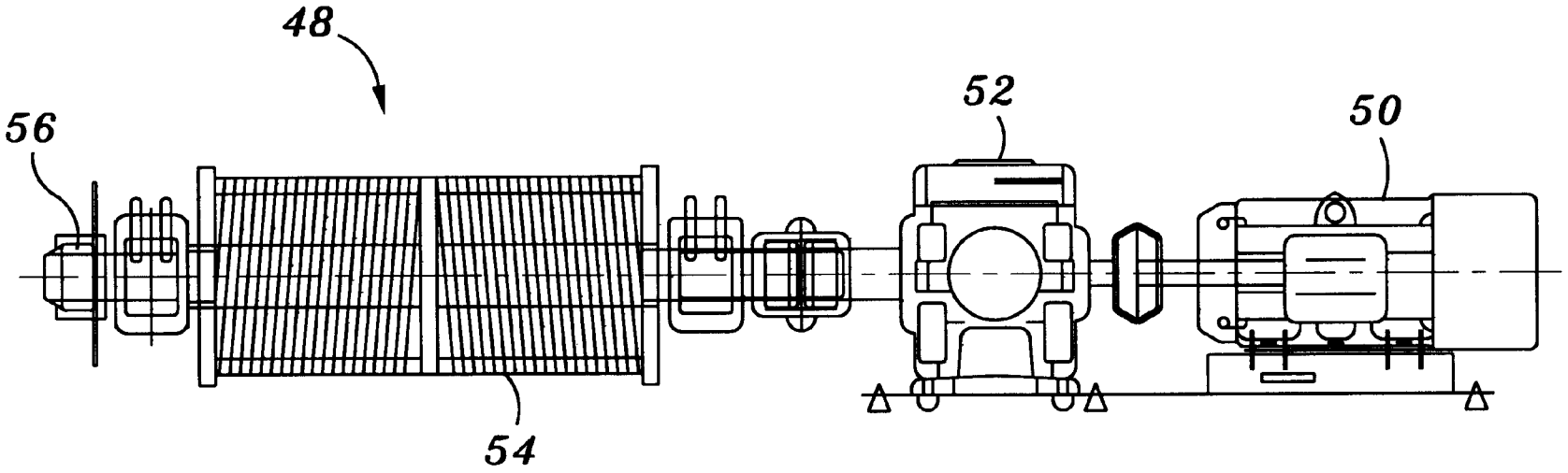
FIG. 8 is a side view of the drive train used to power the counterweight sled assembly shown in FIG. 7, and flying set piece.
Figure 9:
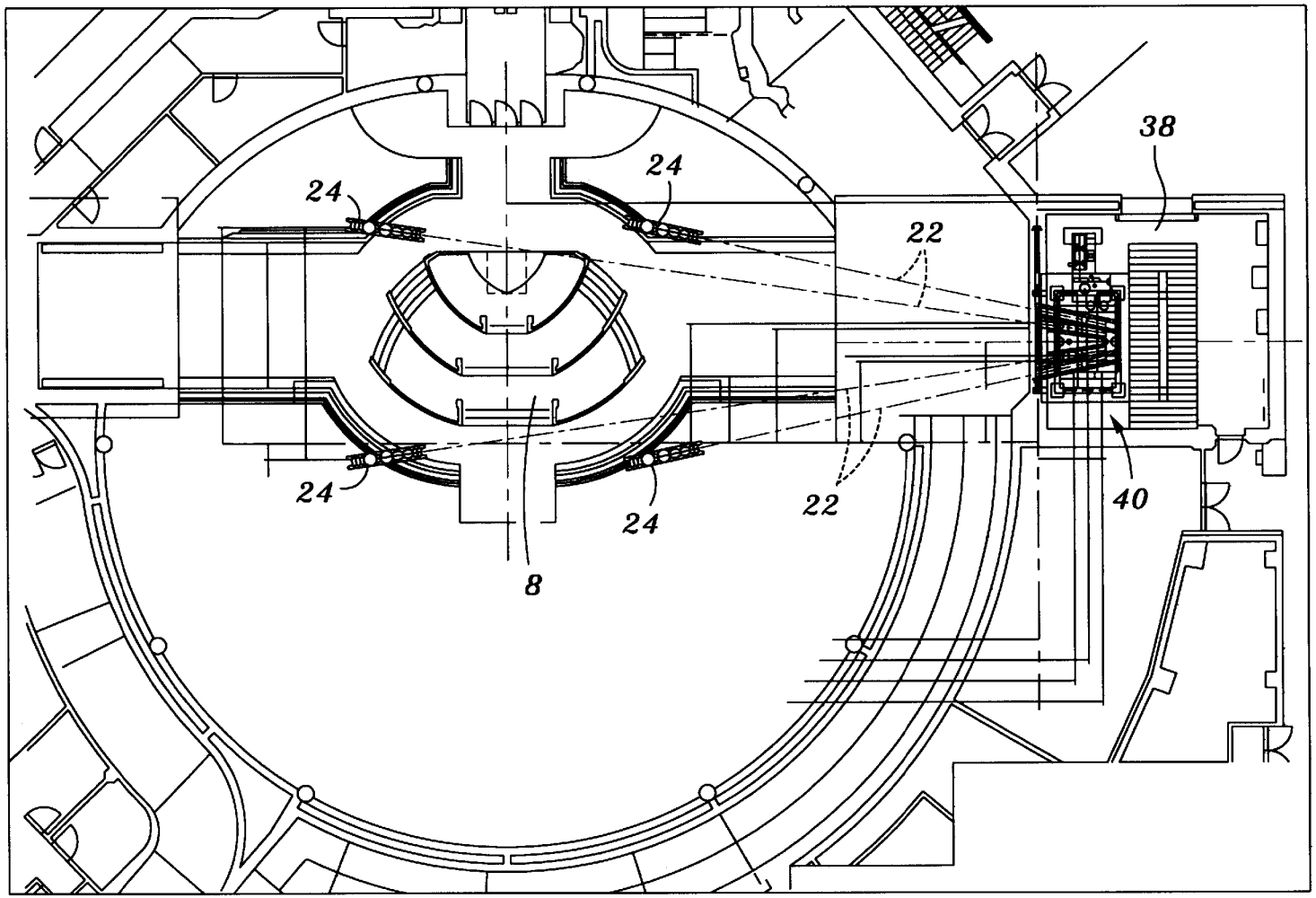
FIG. 9 is a plan view of the viewing area shown in FIG. 1.

Still referring to FIG. 6(*a*), the frame 41 of the counterweight tower assembly 40 (preferably a welded-steel tube structure) is attached to the floor slab and footings in the mechanical room 38. The lower section of the frame 41 encloses the drive train 48. The upper section of the frame 41 is attached to the underside of the ceiling trusses 60. As best shown in FIG. 7, the frame 41 supports the tower load sheaves 42 and the haul rope sheaves 46.

Located within the frame 41 is the counterweight sled assembly 30. The counterweight sled assembly 30 is located on guide rails 32 (shown in FIG. 6(*b*)) positioned on the internal portion of the frame 41. The guide rails 32 run parallel to the length of the frame 41 and traverse the joint between the upper and lower sections of the frame 41. The guide rails 32 permit the counterweight sled assembly 30 to move up and down the tower 41. The counterweight sled assembly 30 has a weight roughly equaling the weight of the flying set piece 12. In the embodiment shown in the drawings, the counterweight sled assembly 30 and flying set piece 12 each weigh about 40,000 pounds.

The counterweight sled assembly 30 rolls up and down along the guide rails 32 to change the position of the flying set piece 12. For example, when the counterweight sled assembly 30 moves upward, the flying set piece 12 moves from the raised position to the lowered position. Conversely, when the counterweight sled assembly 30 moves downward toward the floor of the mechanical room 38, the flying set piece 12 moves from the lowered or down position to the up or raised position. The counterweight sled assembly 30 is pulled up or down by the haul lines or ropes 44. The haul ropes 44 are attached to both the top and bottom of the counterweight sled assembly 30. The haul ropes 44 extend from the top of the counterweight sled assembly 30, pass over the haul rope sheaves 46, wrap around a drive drum assembly 54 of the drive train 48, and attach to a spring-loaded mount 58 located at the bottom of the counterweight sled assembly 30.

As best shown in FIGS. 6(*a*), 7, and 8, the drive train 46 includes several components including an electric motor 50, a drive reduction gear box 52, a drive drum assembly 54, and a drum disk brake 22. The electric motor 50 rotates the drive drum assembly 54 to move the haul ropes 44 attached to the counterweight sled assembly 30.

The counterweight sled assembly 30 is normally slowed or stopped using the control/power system 70 and drive train 48. This system controls the speed of the motor 50 as well as the drum disk brake 56. In an emergency, however, the control/power system 70 and the motor 50 switch into a coast mode, and movement of the counterweight sled assembly 30 and flying set piece 12 is stopped by spring-loaded pneumatically released brakes (not shown) located on the counterweight sled assembly 30. In addition, in the emergency coast mode, the drum disk brake 56 is triggered to slow the counterweight sled assembly 30 and the flying set piece 12. Of course, various other equivalent designs may be used to raise and lower the set piece 12.

In use, guests enter the attraction 2 and proceed through one or more pre-show areas 4. A theatrical performance using actors, projected images, props or the like entertains the guests and sets-up the main attraction to follow. Guests exit the pre-show area 4 (walking, riding, standing on a moving walkway, etc.) and enter the main show area 6. When the guests enter the main show area 6, the flying set piece 12 is in the raised position above the guests. Guests then view the main theatrical production or attraction from the viewing area 8 in the main show area 6. Near the end of the main production, the guests are distracted through the use of special effects such as flashing lights, props, mist, fog or the like. During this distraction period, the flying set piece 12 is quickly lowered around the guests (preferably within about 6 seconds). The guests in the main show area 6 suddenly perceive that they have been magically transported to another area of the amusement ride 2. Preferably, the scenery of the flying set piece 12 resembles that of a previously visited pre-show area 4, such that the guests feel as if they have been instantly transported back to a previous location (i.e., a pre-show area 4).

After completion of the presentation, the guests leave the main show area 6. The flying set piece 12 is raised back to its original raised position above the main show area 6 for the next group of guests (preferably within about 10 seconds).

While embodiments and applications of this invention have been shown and described, it will be apparent to those skilled in the art that many modifications and substitutions of equivalents are possible without departing from the scope of the invention. The invention, therefore should not be restricted except by the following claims and their equivalents.

What is claimed is:

1. An amusement attraction comprising:

a viewing are a in which guests view a theatrical performance or attraction;

a set piece movable between a raised position above the viewing area and a lowered position wherein the set piece at least partially surrounds the viewing area and guests; and a set piece drive system linked to the set piece for moving the set piece between the raised and lowered positions.

2. The attraction of claim 1, the set piece further containing scenery on the interior of the set piece that resembles scenery of a different viewing area of the attraction.

3. The attraction of claim 2, wherein the scenery of the set piece resembles the scenery of a viewing area within the attraction that the guests have previously passed through.

4. An attraction for simulating a set transformation effect for guests comprising:

a pre-show area;

a show viewing area in which the guests view a theatrical performance or attraction after leaving the pre-show area;

an open-bottomed flying set piece displaceable from a raised position above the show viewing area to a lowered position wherein the flying set piece at least partially surrounds the viewing area and guests; and means for moving the flying set piece from the raised position to the lowered position.

5. The attraction of claim 4, said flying set piece further containing scenery on the interior of the flying set piece that resembles scenery of a different viewing area of the attraction.

6. The attraction of claim 5, wherein the scenery of the flying set piece resembles the scenery of a viewing area within the attraction that the guests have previously passed through.

7. The attraction of claim 4 wherein the flying set piece is not visible from the viewing area when the flying set piece is in the raised position.

8. An attraction for simulating a set transformation effect for guests comprising:

a first viewing area in which the guests pass through during the amusement ride;

a second viewing area in which the guests view a theatrical performance or attraction after leaving the first viewing area;

an open-bottomed flying set piece having walls forming an enclosure, and wherein the flying set piece is positionable into a raised position above the second viewing area such that the flying set piece is hidden from the guests entering the second viewing area and positionable into a lowered position, wherein the flying set piece at least partially encloses the guests and the second viewing area;

an overhead rigging system including a plurality of load ropes attached to the flying set piece;

a counterweight tower assembly including a movable counterweight sled assembly connected to the load ropes of the overhead rigging system; and a motor for moving the counterweight sled assembly and the flying set piece into the raised and lowered positions.

9. A method of producing a set transformation effect comprising the steps of:

showing a presentation or attraction to one or more guests in a viewing area, the viewing area including a flying set piece directly over the one or more guests in the viewing area;

distracting the one or more guests during the presentation or attraction in the viewing area; and lowering the flying set piece over the one or more guests during the distracting event, wherein the flying set piece at least partially surrounds the viewing area and the one or more guests after the distracting event occurs.

10. A method according to claim 9, further comprising the step of raising the flying set piece back to the overhead position directly above the viewing area.

11. The method according to claim 9, wherein the distraction is accomplished by introducing fog or mist into the viewing area.

12. An amusement attraction for simulating the magical transportation of guests to a previously viewed area of the amusement attraction comprising:

a pre-show room having a plurality of walls with scenery located on the walls;

a show viewing area in which the guests view a theatrical performance after leaving the pre-show room;

a flying set piece having a plurality of side walls forming an enclosure, and wherein the flying set piece is moveable from a raised position directly above the show viewing area, where the flying set piece is hidden from view of the guests during the theatrical performance, to a lowered position, where the flying set piece at least partially encloses the show viewing area;

flying set piece scenery located on the plurality of side walls and matching the scenery in the pre-show room; and a flying set piece moving system attached to the flying set piece for moving the flying set piece from the raised position to the lowered position.

13. The attraction of claim 12 wherein the flying set piece has an open bottom.

14. The attraction of claim 12 wherein the raised position is directly vertically above the show viewing area.

15. The attraction of claim 12 wherein the moving system comprises ropes attached to the flying set piece and to a counterweight.

16. The attraction of claim 12 further comprising a pre-show ceiling in the pre-show room, with scenery on the pre-show ceiling, and, a flying set piece ceiling on the flying set piece, with the flying set piece ceiling having scenery matching the scenery on the pre-show ceiling.

17. The attraction of claim 16 wherein the flying set piece ceiling comprises an overhead lattice affixed to the plurality of side walls.

* * * * *

UNITED STATES PATENT AND TRADEMARK OFFICE

CERTIFICATE OF CORRECTION

PATENT NO. : 6,074,307

DATED : June 13, 2000

INVENTOR(S) : Phillip D. Hettema and William D. Mason

It is certified that error appears in the above-identified patent and that said Letters Patent is hereby corrected as shown below:

Please add the following inventor:

Mark L. Shumate, Altadena, California

Signed and Sealed this

Eighth Day of May, 2001

*Attest:*

Nicholas P. Godici

NICHOLAS P. GODICI

*Attesting Officer*

*Acting Director of the United States Patent and Trademark Office*